US006050046A

United States Patent [19]

Rykaczewski

[11] Patent Number: 6,050,046

[45] Date of Patent: Apr. 18, 2000

[54] BEDSIDE WALL INSULATOR

[76] Inventor: Stanley Rykaczewski, 26 Miller Rd., Lake in the Hills, Ill. 60102

[21] Appl. No.: 08/971,967

[22] Filed: Nov. 17, 1997

[51] Int. Cl.[7] ..... E04C 2/38

[52] U.S. Cl. ..... 52/718.01; 5/424; 52/717.04; 52/718.04

[58] Field of Search ..... 5/424, 425, 427, 5/907; 52/33, 717.04, 718.01, 718.04

[56] References Cited

U.S. PATENT DOCUMENTS

| | | | |
|---|---|---|---|
| 2,681,716 | 9/1954 | Black | 52/730.1 X |
| 2,843,889 | 7/1958 | Keller | 52/717.04 X |
| 4,672,698 | 6/1987 | Sands | 5/424 |
| 4,710,992 | 12/1987 | Falwell et al. | 5/424 X |
| 5,110,650 | 5/1992 | Kessler | 52/718.04 X |
| 5,149,569 | 9/1992 | McCue | 52/718.04 X |
| 5,191,663 | 3/1993 | Holder et al. | 5/424 |
| 5,606,841 | 3/1997 | Carter, Jr. | 52/802.1 |
| 5,743,064 | 4/1998 | Bennett | 52/718.04 |

FOREIGN PATENT DOCUMENTS

| | | | |
|---|---|---|---|
| 2095986 | 10/1982 | United Kingdom | 5/425 |

*Primary Examiner*—Carl D. Friedman
*Assistant Examiner*—Timothy Kang
*Attorney, Agent, or Firm*—Francis C. Kowalik

[57] ABSTRACT

The invention is a wall insulator adapted to be used in conjunction with a bed or the like when the bed is placed against a wall. The invention prevents a user of the bed from coming into contact with the wall but rather a padded insulated surface.

12 Claims, 2 Drawing Sheets

BEDSIDE WALL INSULATOR

FIELD OF THE INVENTION

The instant invention relates to removable wall coverings adapted to be placed next to a bed or the like so as to prevent a user of the bed from contacting the wall.

BACKGROUND OF THE INVENTION

For many years, people, who due to space contraints have placed their bed lengthwise against a wall, have suffered from a recurring problem; especially, in colder climes, a sleeper would, upon performing the various motions associated with sleep, come in contact with a cold wall. This contact would have several unwanted effects. The first of which would be the awakening of the sleeper thereby effectively preventing a complete night's sleep. Secondly, should the sleeper not be awakened by such contact, and remain in contact with the cold adjacent wall, various muscular spasms could develop, rendering the sleeper, at the very least sore and stiff upon awakening.

The instant invention provides a solution to these problems. An insulating member is releaseably attached to the cold wall by means of a novel affixment. This allows for facile installation by virtually anyone. The insulative member is covered by a removable contact surface which, as will be further described, would be adapted to provide a comfortable surface against which the sleeper can rest. Furthermore, the present invention contemplates the removability and washability of the contact surface so as to maintain sanitation.

Exemplary of prior inventions relating to accouterments adapted for use with beds include:

- U.S. Pat. No. 1,282,281 to Pennington discloses a planar member adapted to be attached to an open tubular bedstead;
- U.S. Pat. No. 2,375,941 discloses a sound-reducing device for beds which comprises a plurality of hinged panels configured so as to be able to essentially enclose a bed from the surrounding room;
- U.S. Pat. No. 4,878,259 to Casey discloses a modular energy-saving covering which comprises an insulating fiber sandwiched between two sheets. These sheets are then attached via snaps or strings to each other so as to provide for a plurality of the sheets to form a substantially planar covering over the object to be insulated.

As can be seen, none of these devices solves the specific problem of contacting a wall disposed longitudinally adjacent a bed.

OBJECTS OF THE INVENTION

It is an object of the invention to provide an insulative wall covering adjacent a bed or the like. It is another object of the invention to provide for an insulating wall covering which is easily installed. It is a further object of the invention to provide for an insulating wall covering which is robust. It is another object of the invention to provide for an insulating wall covering having a removable contact surface. It is another object of the invention to provide an affixment therefor which serves to retain the wall covering in its preferred location whilst allowing for easy removal thereof. It is a further object of the invention to provide a soft resilient surface for a user to rest against. These and other objects of the invention will become apparent from the detailed description of the preferred embodiment, drawings and claims appended hereto.

DETAILED DESCRIPTION OF THE PREFERRED EMBODIMENT

Figure 1:
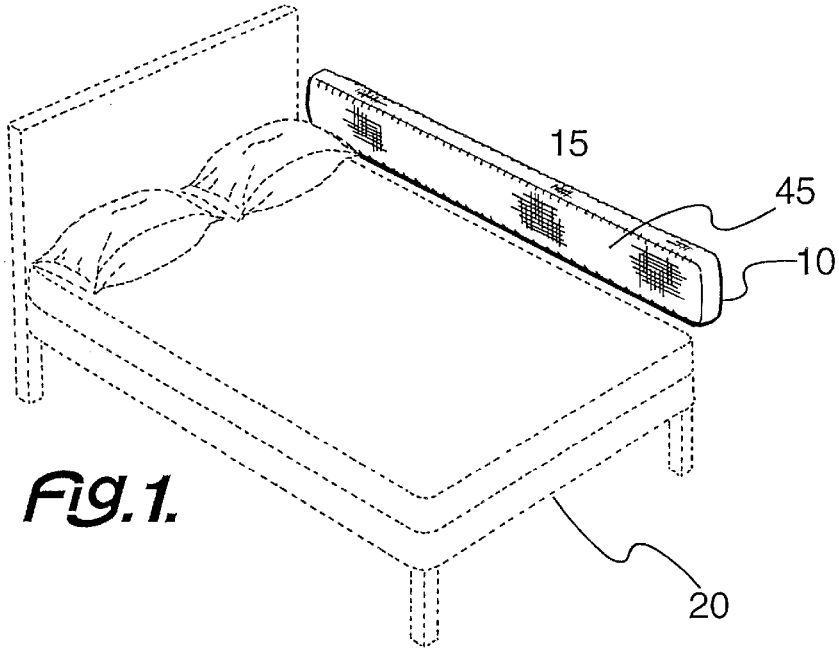
FIG. 1 is a perspective view of the invention as used.
Figure 2:
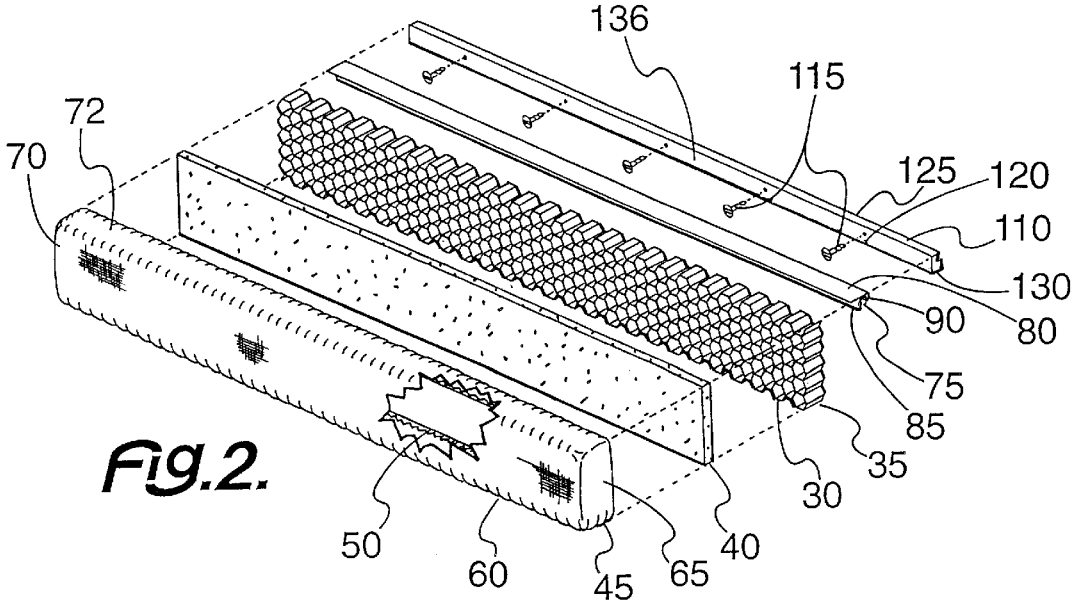
FIG. 2 is an exploded view of the invention.
Figure 3:
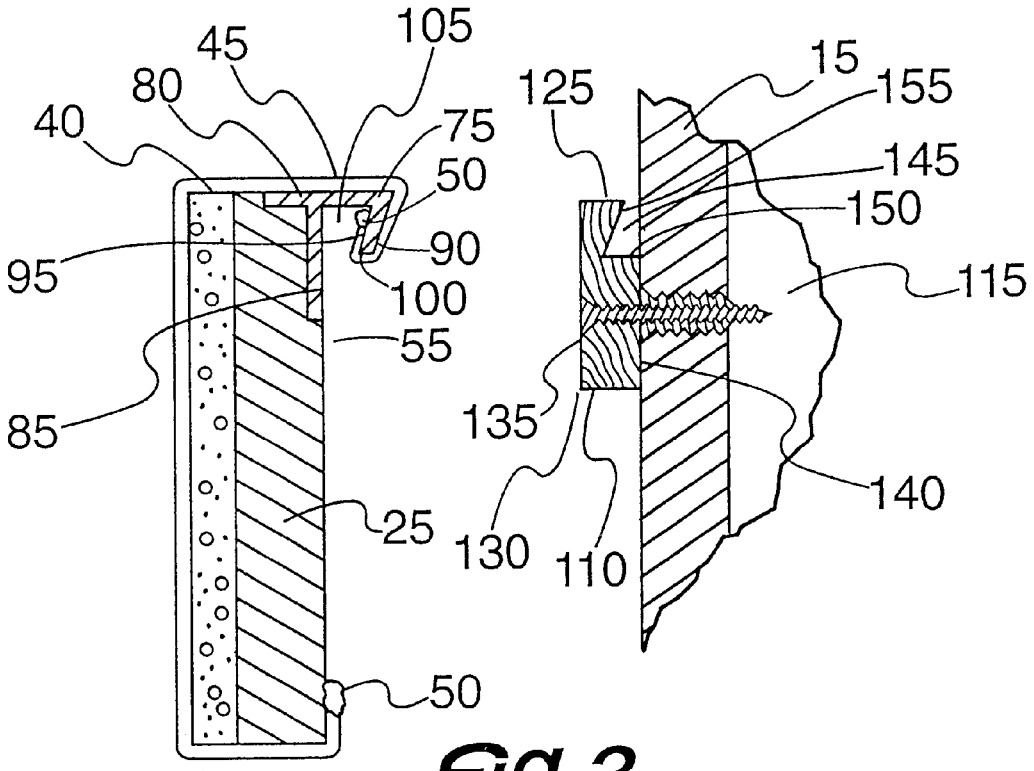
FIG. 3 is an edge-on view of the affixment and bracket.

The instant invention comprehends a panel 10 which is disposed on a wall 15 so as to be longitudinally parallel to a bed or other furniture 20 which is located adjacent thereto. Panel 10 further includes an insulative member 25 which in the preferred embodiment is foamed polystyrene or other plastic having insulating properties or alternatively a sheet or cardboard 35 having faviform or honeycomb shaped corrugations 30 thereon. The choice of material or alternatives thereto is based on the combined requirements of rigidity and insulation. Surrounding the insulative member or core 35 is a layer of resilient padding 40. This padding 40 provides a comfortable subsurface for a user of bed 20 to rest against. Surrounding resilient pad 40 is a removable contact surface 45 which, in the preferred embodiment, is a fabric. The fabric contact surface 45 is chosen for comfort as well as washability as this is the surface that the bed user actually contacts when against the invention. Furthermore as the contact surface 45 is not integral with the panel 10 nor the resilient pad 40, the choice of material used for the outer cover or contact surface 45 is amenable to aesthetic choices. The outer cover or contact surface 45 is retained about panel 10 by an elastic strap 50 disposed on the rear side 55 of panel 20 and attached to outer cover 45. The elastic strap 50 is so disposed to draw outer cover 50 about the bottom 60, first end 65, and second end 70 of panel 10.

The top end 72 of the panel 10 is surmounted by a resilient affixment 75 and is attached thereto. In the preferred embodiment panel 20 is glued to affixment 75 by use of an adhesive appropriate to the panel 10 and affixment 75 material.

Affixment 75 comprehends a backplate 80 which, when installed, is coplanar to the top end 72 of the panel 10. Depending from the backplate 80 and integral thereto, is rib 85. Rib 85 is extensive outwardly from backplate 80 and is disposed to come into coplanar contact with the rear side 55 of panel 10. Looking rearwardly from backplate 80 attachment tang 90 depends therefrom. Tang 90 comprehends an interior side 95 which is disposed toward rib 85. At the distal end of the interior side 95 of tang 90 resides an inwardly extensive lateral extension 100. Lateral extension 100 displays a thickening of tang 90 as the distal end of the tang 90 is approached. Furthermore, tang 90 is biased toward rib 85 thereby defining a capture pocket 105 between tang 90 and rib 85.

Bracket 110 is disposed along the wall 15 and attached thereto by fasteners 115 inserted through mounting holes 120 defined therein. The bracket 110 has defined thereon a top bracket edge 125, a bottom bracket edge 130 and a first bracket side 135 and a second bracket side 140. Disposed longitudinally along the top bracket edge 125 is a receiving groove 145. The receiving groove 145 is in the presently preferred embodiment formed by a first plane 150 disposed parallel to the top bracket edge 125 and interior thereto, and a second plane 155 disposed at an acute angle to the first plane 150, thereby forming receiving groove 145 therebetween. Functionally, bracket 110 would be mounted to wall 15 as aforedescribed with the receiving groove 145 disposed toward the wall 15 and oriented at the top of the bracket 110.

Cover or contact surface 45 is placed about panel 10 and affixment 75, covering capture pocket 105. Panel 20 is then placed at the wall 15 with affixment 75 disposed along the top edge thereof over bracket 110. Panel 20 is then lowered onto bracket 110 until tang 90 snaps into receiving groove 145 and the top bracket edge 125 is sealed in capture pocket 105. As tang 90 is inwardly biased, the panel 20 is now affixed to the bracket 110 and cover or contact surface 45 is trapped between the top bracket edge 125 and capture pocket 105, thereby retaining cover 45 and panel 20 to bracket 110 and, therefore to wall 15.

The above recited description of the presently preferred embodiment is illustrative of the instant invention and should not be construed to incur limitations regarding the invention to any extent greater than recited in the claims herebelow.

In accordance with my invention, I claim:

1. A wall insulator comprising an insulating panel and a bracket wherein said panel is faviform and is covered by an elastically retained contact surface and has a pad placed between said faviform panel and said contact surface, and is engaged to said bracket and is suspended therefrom and a means for engaging said panel to said bracket wherein said means for engaging said panel to said bracket has a top edge and a receiving groove receiving said panel with said receiving groove being defined by a first planar surface and a second planar surface and said first planar surface and said second planar surface define an acute angle therebetween so as to capture said panel within said acute angle.

2. The invention according to claim 1, wherein said bracket further comprises a top edge receiving said means for engaging said panel to said bracket.

3. The invention according to claim 1, wherein said means for engaging said bracket further comprises an affixment having a rib and a tang dependent therefrom.

4. The invention according to claim 3, wherein said rib and tang define a capture pocket therebetween which captures said top edge of said bracket.

5. The invention according to claim 3, wherein said tang has a distal end having a lateral extension directed inwardly toward said capture pocket.

6. An insulating device adapted to be attached to a wall adjacent an object or furniture so as to prevent contact between a user of said object or furniture and said wall comprising a faviform panel surrounded by a removable contact surface wherein said contact surface is elastically retained on said faviform panel and a bracket, removably engaged to said faviform panel wherein said bracket further comprises a first surface and a second surface and said faviform panel further comprises an affixment having a receiving groove defined by said first surface and said second surface, and a tang and a rib which extends into said groove thereby removably affixing said panels to said bracket.

7. The invention according to claim 6, wherein said affixment further comprises a backplate having said tang dependent therefrom.

8. The invention according to claim 7, wherein said tang has a distal end and which displays a lateral extension.

9. A wall insulator adapted to be used in conjunction with a bed, said bed being located adjacent to a wall, said insulator comprising a rigid panel having thermal insulating properties, by means of said panel having faviform construction and a bracket receiving said panel wherein said panel is extensive along said bracket and is releaseably affixed thereto by means of said bracket having a first surface and a second surface with said first surface and said second surface defining an acutely angled receiving groove therebetween and said panel is inserted into said groove and retained therein; said panel being covered by a pad and a contact surface, wherein said contact surface is removable from said panel.

10. The invention according to claim 9, wherein said panel is formed of foamed polystyrene.

11. The invention according to claim 9, wherein said contact surface is elastically retained about said panel.

12. The invention according to claim 11, wherein said panel further comprises an affixment having a tang which is compressively received by said groove.

* * * * *